United States Patent [19]

Wang

[11] Patent Number: 4,929,174

[45] Date of Patent: May 29, 1990

[54] GAS LIGHTER WITH SPARK IGNITION

[76] Inventor: Ming-I Wang, No. 6, Lane 97 Hsi-Yuan Rd. Homei, Changhua, Taiwan

[21] Appl. No.: 326,793

[22] Filed: Mar. 21, 1989

[51] Int. Cl.[5] ..... F23Q 1/02

[52] U.S. Cl. ..... 431/276; 431/277; 431/344

[58] Field of Search ..... 431/344, 276, 277, 254, 431/255, 143

[56] References Cited

U.S. PATENT DOCUMENTS 3,905,755 9/1975 Aske ..... 431/344

4,310,297 1/1982 Kitabayashi ..... 431/254

*Primary Examiner*—Carroll B. Dority

*Attorney, Agent, or Firm*—Fleit, Jacobson, Cohn, Price, Holman & Stern

[57] ABSTRACT

A lighter including a machine housing, a nozzle assembly, an adjusting assembly, a grinding assembly and a filling assembly is provided to provide a flame having an inner flame and an outer flame and uneasy to be blown out. A burning tube is provided to mount at the intermediate portion thereof a disturbing disk defining thereabove a combustion chamber and decelerating the mixed air and gas to provide the inner flame in the combustion chamber.

4 Claims, 5 Drawing Sheets

GAS LIGHTER WITH SPARK IGNITION

BACKGROUND OF THE INVENTION

The present invention relates to a lighter, and more particularly to a lighter having a grinding assembly.

Lighters can be largely categorized into the following types:

1. The conventional type as shown in FIG. 1 is rarely used now since the wick is easily consumed, the flame cannot be controlled, it generates a bad odor and it is troublesome to fill with lighter fluid.

2. The gas type as shown in FIG. 2 suffers from the same disadvantage that it is difficult or uneasy for it to flame if there is a wind and the flame it provides gets blown out easily.

3. The electrical type as shown in FIG. 3 has a volume amounting to about 5 times that of the usual lighter and is energy-consuming. In addition, the heating wire needs to be cleaned often if the user wants to ignite a cigarette easily.

4. The nozzle type as shown in FIGS. 4–4B, includes a costly complicated nozzle having an iron net I, a conical gas-dividing head H, and an accelerating piece requiring manufacture by a laser machine. It further needs a piezoelectrical crystal igniter, gets out of order relatively frequently, and has an outer flame having a height only equal to ¼–1/6 that of the inner flame which compels that the article to be ignited must be held relatively near the nozzle opening which thus gets contaminated easily.

5. The wind-preventing type as shown in FIG. 5 includes a wind-preventing piece which must be oriented toward the direction of the wind upon lighting. In use, it is found that if the wind is relatively stronger, the flame is unstable and gets blown out easily.

It is therefore attempted by the Applicant to deal with the above shortcomings encountered by the prior art.

SUMMARY OF THE INVENTION

A major object of the present invention is to provide a lighter providing a flame resisting getting blown out.

It is further an object of the present invention to provide a lighter which will resist contamination.

According to the present invention, a lighter includes a machine housing, a nozzle assembly, an adjusting assembly, a grinding assembly and a filling assembly in which the nozzle assembly includes a nozzle seat capable of mixing therein an air and a gas, an accelerating piece having a relatively small hole therethrough by which the gas is accelerated, a burning tube connected to the nozzle seat and having an intermediate portion and an upper side hole capable of receiving a spark therefrom, and a distrubing disk secured to and disposed within the intermediate portion to define thereabove a combustion chamber, having a plurality of holes evenly distributed, and capable of decelerating the mixed air and gas.

The present invention may best be understood through the following description with reference to the accompanying drawings, in which:

DETAILED DESCRIPTION OF THE PREFERRED EMBODIMENT

Figure 1:
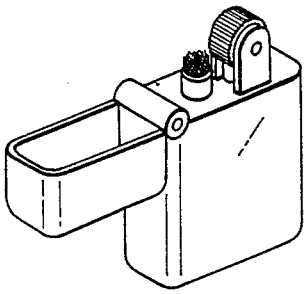
FIG. 1 PRIOR ART
FIG. 1 is a perspective view showing a lighter of the conventional type.
Figure 2:
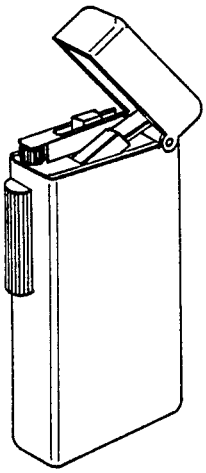
FIG. 2 PRIOR ART
FIG. 2 is a perspective view showing a lighter of the gas type according to the prior art.
Figure 3:
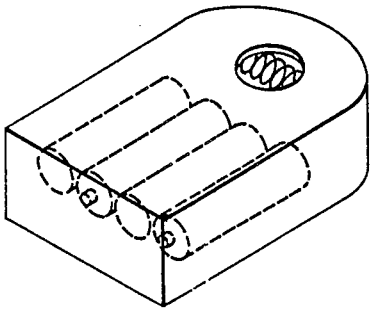
FIG. 3 PRIOR ART
FIG. 3 is a schematic perspective view showing a lighter of the electrical type according to the prior art.
Figure 4:
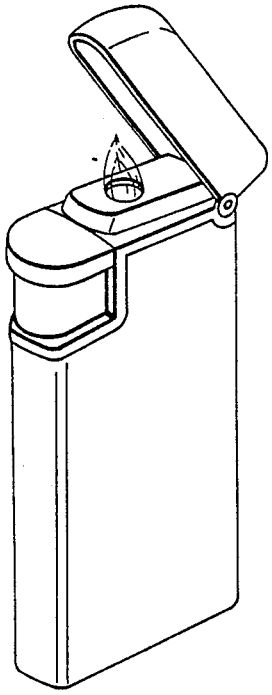
FIG.4 PRIOR ART
FIG. 4 is a perspective view showing a lighter of the nozzle type according to the prior art.
Figure 4A:
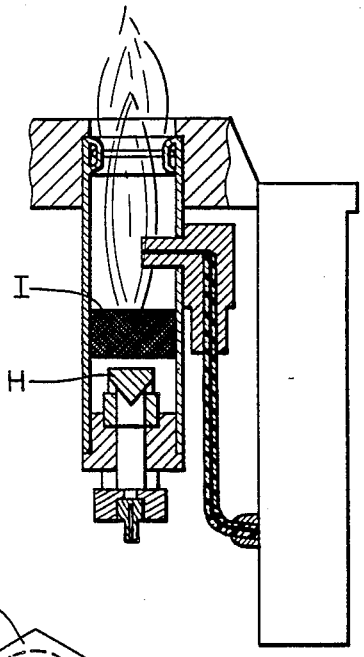
FIG.4A PRIOR ART
FIG. 4A is a sectional view showing the relevant parts of the lighter in FIG. 4.
Figure 4B:
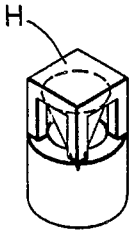
FIG.4B PRIOR ART
FIG. 4B is a perspective view showing a conical gas-dividing head for the lighter in FIG. 4.
Figure 5:
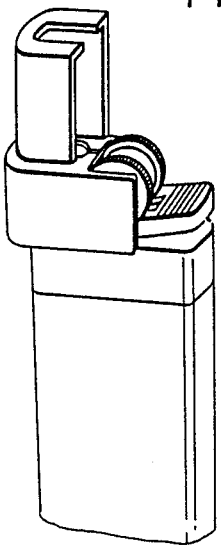
FIG.5 PRIOR ART
FIG. 5 is a perspective view showing a lighter of the wind-preventing type according to the prior art.
Figure 6:
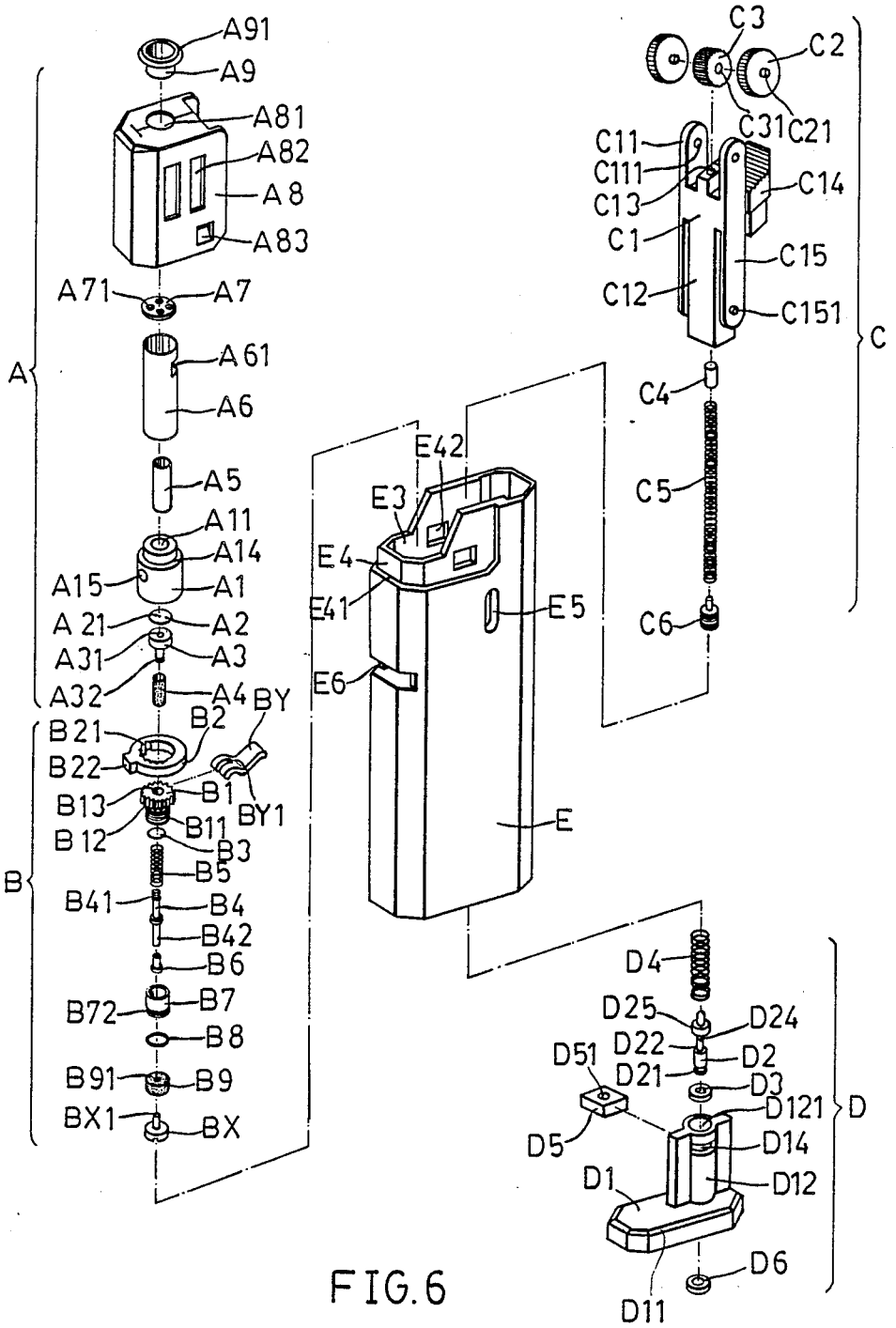
FIG. 6 is an exploded view showing a lighter according to the present invention.
Figure 7A:
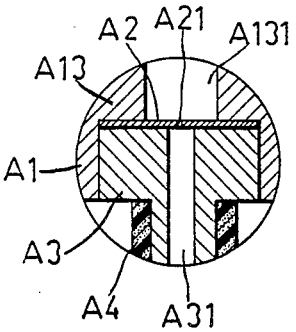
FIG. 7A is an enlarged view showing the corresponding part circled in FIG. 7.
Figure 7:
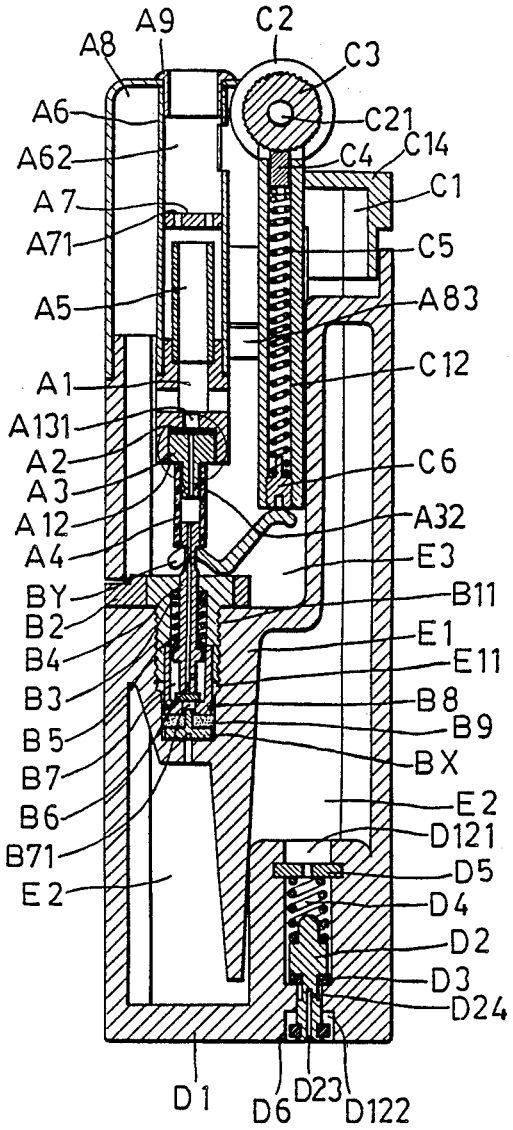
FIG. 7 is a sectional view showing the lighter in FIG. 6.

Referring now to FIGS. 6-7A, a lighter according to the present invention includes a nozzle assembly A, an adjusting assembly B, a grinding assembly C, a filling assembly D, and a machine housing E. Nozzle assembly A includes a nozzle seat A1, an accelerating piece A2 being disk-shaped and having a relatively small central hole A21, a connector A3, a connecting tube A4 made of heat-resistant rubber, a guiding tube A5, a burning tube A6, a disturbing disk A7, a heat-dissipating piece A8, and a securing button A9. Seat A1 includes an outer shoulder A14, a transverse through air vent A15, and a longitudinal shouldered through hole A131 having a lower portion A12 coaxially receiving therein accelerating piece A2 and an upper portion A11 receiving therein an end of guiding tube A5 having the opposite end thereof upwardly extended to a point spaced slightly below disk A7. Connector A3 being Z-stepped includes a through hole A31 and a lower annular groove A32 capable of tightly attaching thereto an end of rubber tube A4 and has a largest diameter capable of allowing the respective part of connector A3 to be tightly received in lower portion A12 to tightly urge accelerating piece A2 against the inner shoulder of seat A1 so that all flow can only pass through central hole A21. Burning tube A6 has a bottom end matching against outer shoulder A14, an upper side hole A61, and an intermediate portion transversely securing therein and thereto a disturbing disk A7 which defines thereabove a combustion chamber A62 in tube A6 and includes a plurality of holes A71 evenly distributed around the axis of tube A6. Heat-dissipating piece A8 has a top hole A81, and two opposite side clamping plates A82 which respectively include two lower retainers A83 enabling piece A8 to be securely retained to machine housing E and are capable of immovably clamping therebetween burning tube A6. Securing button A9 includes a top lip A91 for resting on piece A8 and has a diameter capable of allowing itself to be press-fitted into burning tube A6.

Adjusting assembly B includes an adjusting nut B1, an adjusting ring B2 having inner teeth B21 and an outer projection B22, an O-ring B3, a gas tube B4 having a lower gas vent B42 and an upper annular groove B41 capable of tightly attaching thereto the opposite end of rubber tube A4 capable of isolating the heat generated in assembly A from transmitting to tube B4, a compression spring B5 mounted between tube B4 and O-ring B3 urged in nut B1, a blocking valve B5 positioned under tube B4, a bottomed sleeve B7 having a bottom hole B71 and a lower annular groove B72 and being tightly partly received in nut B1 in the manner that hole B71 is blocked by valve B6 is tube B4 is not upwardly lifted to disengage valve B6 from hole B71, a further O-ring B8 positioned in annular groove B72, an adjusting sponge B9 having a central hole B91, an adjusting medium BX having a central projection BX1 passing through central hole B91 to be positioned in bottom hole B71, and an actuating bent piece BY having a front slot BY1 engaging therein an upper portion of tube B4 and a bent middle resting on nut B1 in the manner that when grinding assembly C is downwardly urged to downwardly move the rear end of bent piece BY, tube B4 is accordingly lifted. Nut B1 includes an outer thread B11 capable of threadedly engaging in an adjusting room E11 of machine housing E, an outer toothed surface B12 engaging with teeth B21, and a through hole B13 passing therethrough the upper portion of tube B4 engaging with tube A4 and bent piece BY.

Grinding assembly C includes a grinding body C1, two plate wheels C2 having respectively two axles C21, a grinding wheel C3 having a axial hole C31 having two opposite ends respectively partly receiving therein axles C21, a flint C4, a spring C5, and a securing bolt C6. Grinding body C1 includes two top lugs C11 respectively having two holes C111 respectively partly receiving therein axles C21, a vertical extension C12 engaging with actuating bent piece BY, a vertical through hole C13 retaining therein flint C4 and spring C5 by securing bolt C6, an actuating medium C14 to be downwardly actuated by the thumb of a user, and two arms C15 respectively having near two free ends thereof two projections C151.

Filling assembly D includes a transparent plastic base D1 having a bottom piece D11 connected to machine housing E and a side filler D12 having an upper transverse rectangular through hole D14 and a longitudinal shouldered through hole having an upper portion D121 and a lower portion D122, a filler D2 axially mounted in shouldered through hole (D121, D122), a first packing D3, a spring D4, a square piece D5 having a central through hole D51 and capable of being inserted into rectangular hole D14 to cooperate with filler D2 to mount therebetween spring D4, and a second packing D6. Filler D2 has a lower annular groove D21 retaining therein packing D6, an intermediate annular groove D22 retaining therein packing D3 and having a wall hole D24 communicating with an axial filling hole D23 provided in Filler D2, and an upper shoulder D25 upon which spring D4 rests to always urge filler D2 in a closed position.

Machine housing E includes a separating frame E1 having therein an adjusting room E11, a fuel gas tank E2, a receiving room E3, a top stepped wall E4 having a shoulder E41 and two side holes E42, two vertical grooves E5, and an intermediate rectangular hole E6 for receiving therethrough projection B22 of adjusting ring B2.

Upon assembling, machine housing E sealingly attaches thereto filler assembly D and adjusting assembly B to isolate fuel gas tank E2 from the environment, heat-dissipating piece A8 seated on shoulder E41 has retainers A83 retained in side holes E42, and projections C151 of arms C15 are slidably engaged in vertical grooves E5. Thereafter, it is readily apparent that if filler D2 is urged upwardly, one can fill the fuel gas through axial filling hole D23, wall hole D24, upper portion D121 and central hole D51 into gas tank E2.

Figure 8:
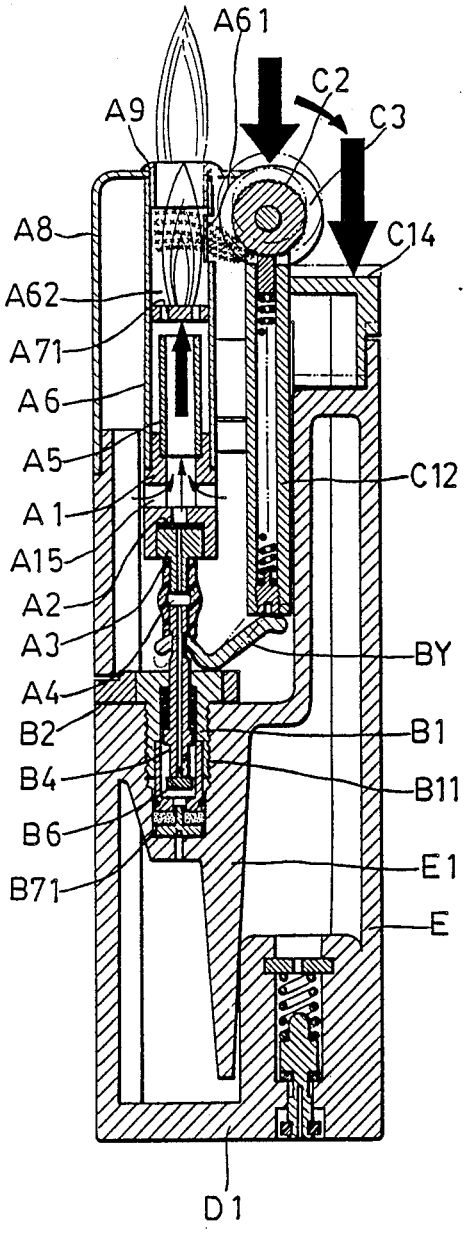
FIG. 8 is a sectional view schematically showing the operation of a lighter according to the present invention.

In use, as shown in FIG. 8, when the user's thumb rotates grinding wheel C3 to provide a spark, grinding body C1 is downwardly displaced simultaneously to downwardly urge the rear end of actuating piece BY to upwardly lift tube B4 to provide a gas, through bottom hold B71, tubes B4, A4, connector A3, accelerating piece A2, and distrubing disk A7 decelerating the mixed air and gas, into combustion chamber A62 to be ignited by the spark. If the user's thumb downwardly urging actuating medium C14 is not released, the gas is continuously supplied in the above manner. It is to be noticed that the gas coming from accelerating piece A2 has a relatively high speed and thus it draws air from air vent A15 to be mixed in seat A1 and tube A5. The present lighter can thus provide a flame having an inner flame in combustion chamber A62 and an outer flame positioned above securing buton A9, and incapable of being blown out easily. If the thumb is released, compression spring B5 restores blocking valve B6 and grinding body C1 into their non-actuated positions respectively.

Through the above description, it can be realized that the present lighter it most advanced but relatively low in cost.

What I claim is:

1. A lighter comprising a machine housing attaching thereto a nozzle assembly capable of providing a flame, an adjusting assembly capable of adjusting the flaming degree of said flame, a grinding assembly capable of providing a spark to enable said nozzle assembly to provide said flame, and a filling assembly capable of filling in said machine body a fuel gas for said flame, characterized in that said nozzle assembly includes:

a nozzle seat positioned in said machine housing and capable of mixing therein an air and a gas supplied from said fuel gas;

an accelerating piece connected to said nozzle seat and having a relatively small hole therethrough by which said gas to be mixed with said air is accelerated;

a burning tube secured to said machine housing, connected to said nozzle seat, and having an intermediate portion and an upper side hole capable of receiving therefrom said spark; and a distrubing disk transversely secured in and to said intermediate portion to define thereabove a combustion chamber, having a plurality of holes evenly distributed around an axis of said burning tube, and capable of decelerating said mixed air and gas coming from said nozzle seat.

2. A lighter according to claim 1, further comprising a guiding tube coaxially mounted in said burning tube and having an end fixed to said nozzle seat and an opposite free end lower than said distrubing disk for centrally guiding said mixed air and gas to flow against said disturbing disk.

3. A lighter according to claim 1 wherein said filling assembly includes:

a base having a side filler seat having a longitudinal shouldered through hole and an upper transverse rectangular through hole;

a square piece having a central through hole and capable of being inserted into said rectangular hole to be retained by said side seat;

a filler coaxially mounted in said shouldered through hole, and capable of being actuated in a first filling position and in a second closed position; and a spring mounted between said square piece and said filler for always urging said filler in said closed position.

4. A lighter according to claim 1 wherein said grinding assembly includes a grinding body having two arms respectively having near two free ends thereof two projections respectively vertically slidable within two grooves respectively provided on two opposite verticaly walls of said machine body.

* * * * *